US008671910B2

(12) United States Patent
Kurita et al.

(10) Patent No.: US 8,671,910 B2
(45) Date of Patent: Mar. 18, 2014

(54) INTAKE AIR QUANTITY CONTROL DEVICE FOR INTERNAL COMBUSTION ENGINE

(75) Inventors: Kazuhisa Kurita, Chiyoda-ku (JP); Chiaki Sugano, Chiyoda-ku (JP); Teruhiko Moriguchi, Chiyoda-ku (JP); Yoshiki Saiki, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 315 days.

(21) Appl. No.: 13/274,825

(22) Filed: Oct. 17, 2011

(65) Prior Publication Data

US 2012/0291751 A1 Nov. 22, 2012

(30) Foreign Application Priority Data

May 20, 2011 (JP) ..... 2011-113478

(51) Int. Cl.
*F02D 9/08* (2006.01)

(52) U.S. Cl.
USPC ..... 123/337

(58) Field of Classification Search
USPC ..... 123/337, 403; 73/114.36
See application file for complete search history.

(56) References Cited

U.S. PATENT DOCUMENTS

| | | | | |
|---|---|---|---|---|
| 6,279,535 | B1 | 8/2001 | Matsusaka | |
| 7,055,498 | B2 * | 6/2006 | Hashimoto et al. | 123/361 |
| 7,073,483 | B1 * | 7/2006 | Kurita et al. | 123/337 |
| 7,121,259 | B2 * | 10/2006 | Wayama et al. | 123/399 |
| 7,458,360 | B2 * | 12/2008 | Irihune et al. | 123/337 |
| 7,958,865 | B2 * | 6/2011 | Ichikawa et al. | 123/337 |
| 8,375,921 | B2 * | 2/2013 | Uchiyama et al. | 123/337 |
| 8,474,434 | B2 * | 7/2013 | Uchiyama et al. | 123/337 |

FOREIGN PATENT DOCUMENTS

| | | |
|---|---|---|
| JP | 2000-130210 A | 5/2000 |
| JP | 2005-337206 A | 12/2005 |

OTHER PUBLICATIONS

Japanese Office Action dated Jun. 27, 2012 issued in Japanese Patent Application No. 2011-113478.

* cited by examiner

*Primary Examiner* — Hai Huynh
(74) *Attorney, Agent, or Firm* — Sughrue Mion, PLLC

(57) ABSTRACT

In the intake air quantity control device for an internal combustion engine, in which an open area formed at a portion of the throttle body is encapsulated by a cover including a rotational angle detector, a throttle gear is fixed to a throttle shaft for rotatably supporting a throttle valve and has a fitting portion at a portion of the throttle gear. The rotational angle detector includes a rotor that is rotatably supported and arranged in the cover in such a way that an axis of the rotor is identical to an axis of the throttle gear, and a lever that is provided at a portion of the rotor, which is faced to the throttle shaft, and engaged to a wall portion of the throttle gear at a portion of the lever.

9 Claims, 10 Drawing Sheets

INTAKE AIR QUANTITY CONTROL DEVICE FOR INTERNAL COMBUSTION ENGINE

BACKGROUND OF THE INVENTION

1. Technical Field

The present invention relates to an intake air quantity control device for an internal combustion engine, and particularly relates to an intake air quantity control device including a rotational angle detector for detecting a rotational angle of a throttle valve.

2. Background Art

In conventional intake air quantity control devices that include a rotational angle detector for detecting a rotational angle of a throttle valve, there is a known intake air quantity control device in which a flat portion is provided at an end portion of a throttle shaft, and a supporting hole is provided at a rotor that is rotatably supported in a throttle body, and a rotational angle of the throttle shaft is detected by fitting the flat portion and the supporting hole with each other (for example, refer to Patent Document 1).

In the rotational angle detector, the flat portion at the end portion of the throttle shaft is arranged in parallel with an intake air passage of the throttle body in a state where the throttle valve is totally closed, whereby a deviation arising at a fitting portion is suppressed at a minimum value.

Moreover, in conventional intake air quantity control devices that include a rotational angle detector and control an aperture ratio of a throttle valve by a motor, there is a known intake air quantity control device in which a rotational angle detector and a cover for installing a drive unit are integrated (for example, refer to Patent Document 2).

CONVENTIONAL ART DOCUMENT

Patent Document

Patent Document 1
Japanese Patent Publication No. 4523397
Patent Document 2
Japanese Laid-Open Patent Publication No. 2000-130210

SUMMARY OF THE INVENTION

Problems to be Solved by the Invention

In the conventional rotational angle detector described in Patent Document 1, because both ends of the flat portion are not concurrently contacted when the rotational angle detector is connected in a state where an axis of the throttle shaft is deviated from an axis of the rotational angle detector, there have been problems in that only one end of the flat portion is contacted, and an output error easily arises. Moreover, because the flat portion at the end portion of the throttle shaft is not parallel with the intake air passage of the throttle body in a state where the throttle valve is partly opened, there has been a problem in that an output error of the rotational angle detector arises in accordance with a deviation at the fitting portion.

Moreover, because a radius of a portion, at which the throttle shaft is fitted to the rotational angle detector, is small, there has been a problem in that the output error of the rotational angle detector is large with respect to the deviation arising at the fitting portion.

In the conventional rotational angle detector described in Patent Document 2, because a lever portion used for a fitting portion between a throttle body and a rotational angle detector is provided at a tip of a throttle shaft, there has been a problem in that a number of components is increased.

Moreover, because the fitting portion is rotated, in a direction where it is protruded to an opposite side of a motor, when the throttle shaft is rotated, there has been a problem in that the throttle body gets larger in order to ensure a rotational radius of the fitting portion.

Furthermore, because a gear tooth portion of a throttle gear is nearly parallel with a connecting position of the throttle shaft to the throttle gear, and the lever portion is provided at the tip of the throttle shaft, there has been a problem in that there is no space in a drive chamber in which gear components are installed, and the rotational angle detector installed in a cover must be protruded from an outer surface of the cover, so that the throttle body gets larger.

The present invention has been made to solve above-described problems, and an object of the invention is to provide an intake air quantity control device having a simple configuration with few components, by which output stability of the rotational angle detector is improved, and the intake air quantity control device can be miniaturized, and an assembly operation capability can be improved.

Means for Solving Problems

An intake air quantity control device for an internal combustion engine of the present invention includes a throttle body that comprises a throttle valve component for openably/closably supporting a throttle valve by a throttle shaft, and a drive chamber for installing a motor for driving the throttle valve, wherein an open area formed at a portion of the throttle body is encapsulated by a cover including a rotational angle detector, and further includes a fan-shaped throttle gear fixed to one end portion of the throttle shaft and having a fitting portion at a portion of the throttle gear, wherein said rotational angle detector comprising:

a rotor that is rotatably supported and arranged in the cover in such a way that an axis of the rotor is identical to an axis of the throttle gear; and a lever that is provided at a portion of the rotor, which is faced to the throttle shaft, and a part of which is engaged to the fitting portion of the throttle gear.

Effects of the Invention

In the intake air quantity control device for an internal combustion engine according to the present invention, a separate space for providing a fitting portion is not required by providing the fitting portion at a fan-shaped portion of the throttle gear, and a length of the intake air quantity control device in an orthogonal direction with respect to the throttle shaft can be decreased. Moreover, because an additional component for forming the fitting portion is not required, a number of the components can be reduced.

Moreover, in the intake air quantity control device for an internal combustion engine according to the present invention, the fitting portion of the throttle gear can be provided at a portion that is significantly separated from an axial position of the throttle gear, and located at a position where a radial length of a fan-shaped area in the throttle gear is fully large, therefore, an influence of a clearance, which is exerted on the rotational angle detected by the rotational angle detector, can be reduced at a minimum value.

Furthermore, in the intake air quantity control device for an internal combustion engine according to the present invention, the fitting portion of the throttle gear is provided by forming a through-hole, and the throttle gear can be formed so as to insert a protruding portion of a lever of the rotational angle detector into the through-hole. Therefore, a length of the intake air quantity control device in an orthogonal direction with respect to the throttle shaft can be decreased.

DETAILED DESCRIPTION OF THE PREFERRED EMBODIMENTS

Hereinafter, each embodiment of the present invention will be explained in reference to drawings. Here, reference symbols, which are the same as those in each drawing, refer to the same or equivalent parts.

Embodiment 1

Figure 1:
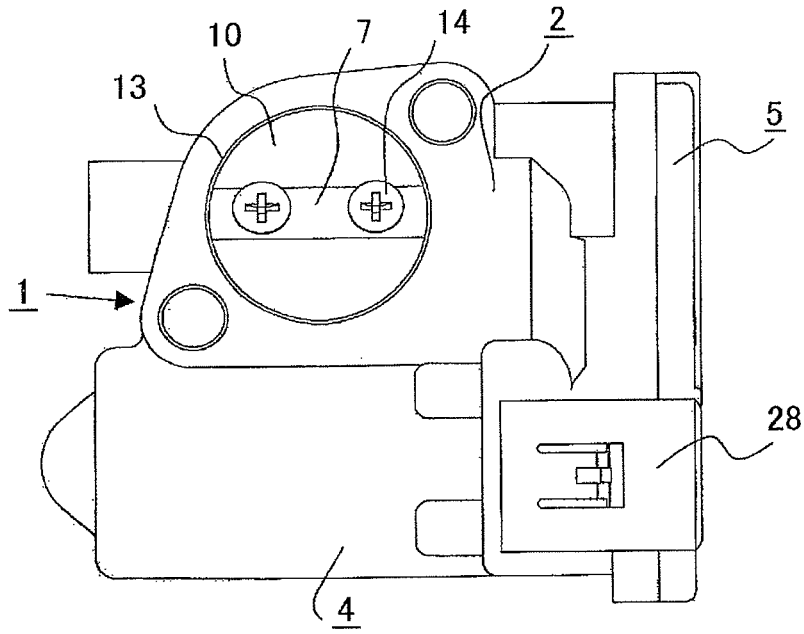
FIG. 1 is a front view illustrating an intake air quantity control device for an internal combustion engine according to Embodiment 1 of the present invention.
Figure 2:
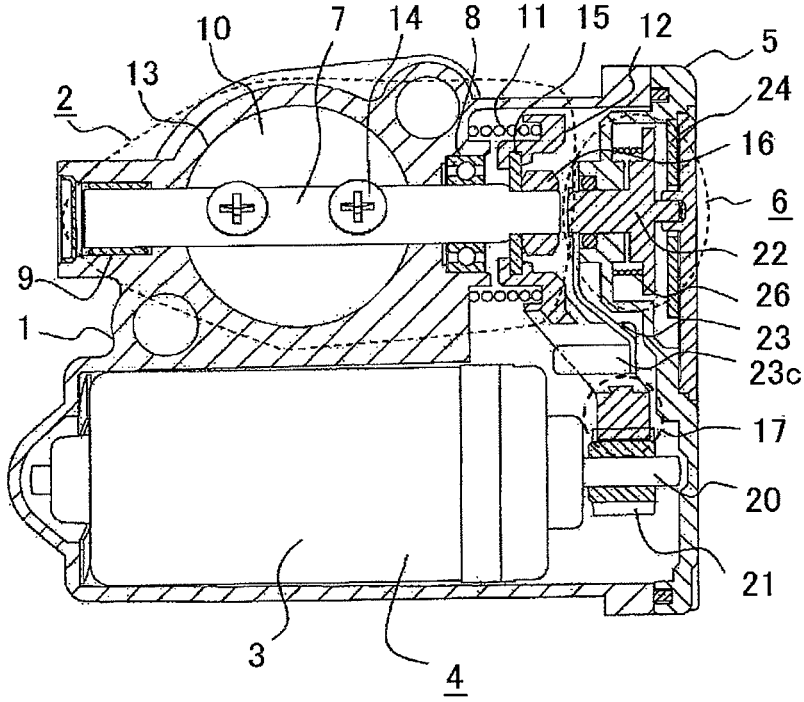
FIG. 2 is a front cross-sectional view illustrating the intake air quantity control device in FIG. 1.
Figure 3:
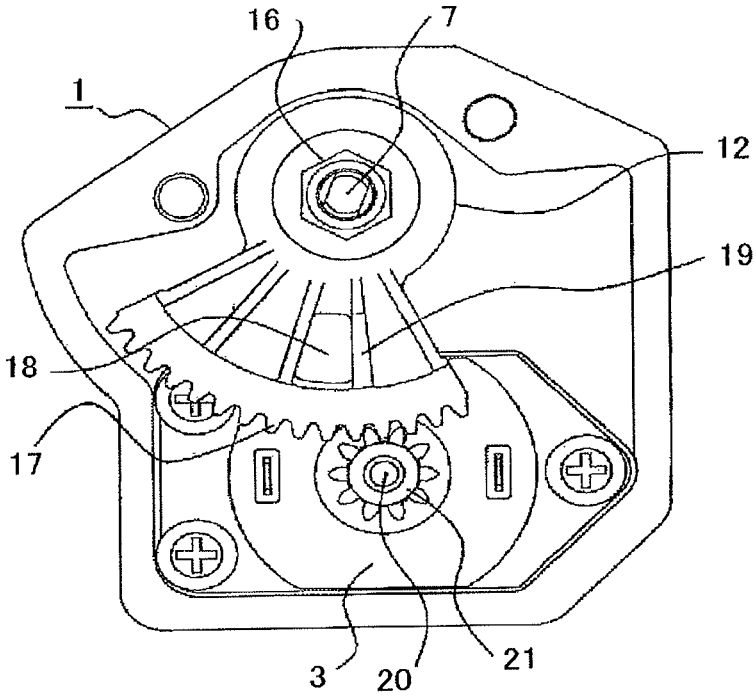
FIG. 3 is a side view illustrating a drive unit in FIG. 1, in a state where a cover is detached.
Figure 4:
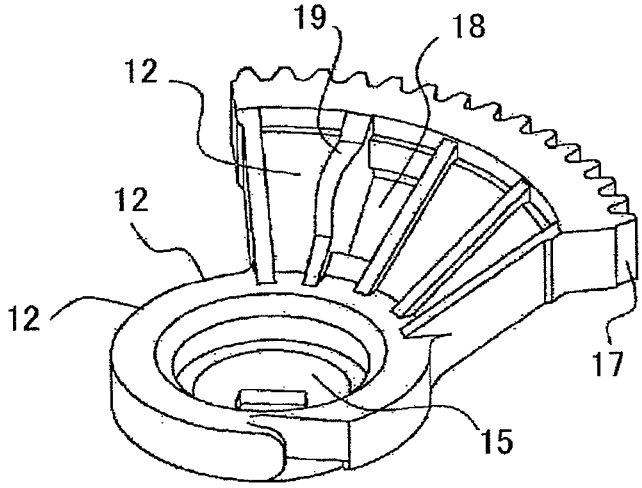
FIG. 4 is an oblique perspective view illustrating a throttle gear unit in FIG. 1.
Figure 5:
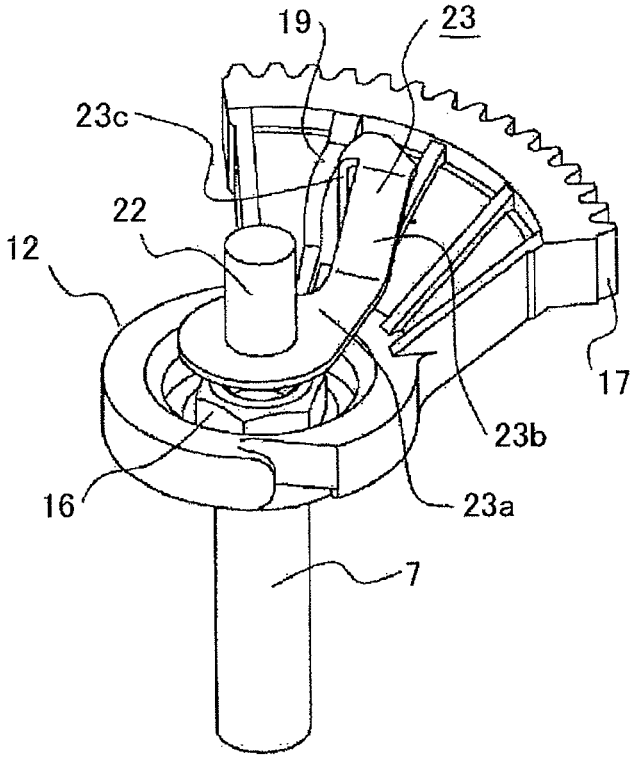
FIG. 5 is an oblique perspective view illustrating a fitting state of a throttle gear and a protruding portion of a lever, in which only neighboring components of the throttle gear are extracted.
Figure 6:
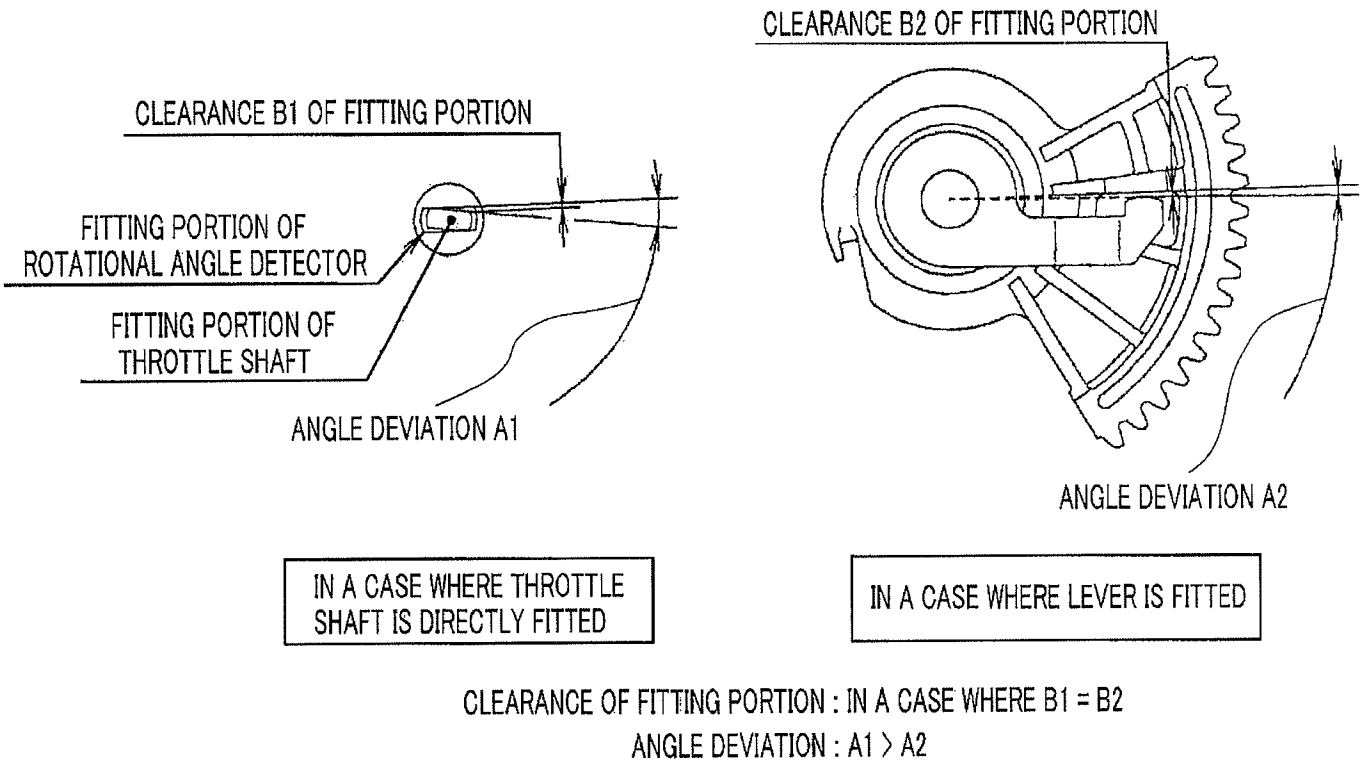
FIG. 6 is an explanatory diagram illustrating an example of an angle deviation with respect to a clearance of a fitting portion in the present invention, which is compared with an angle deviation in a conventional art.
Figure 7:
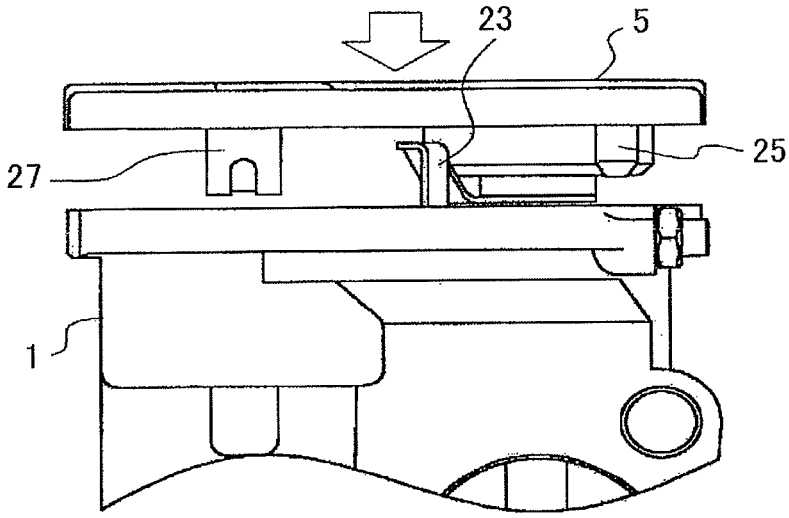
FIG. 7 is a side view illustrating a connection state of the cover and a throttle body.

FIG. 1 is a front view illustrating an intake air quantity control device according to Embodiment 1 of the present invention. FIG. 2 is a front cross-sectional view illustrating the intake air quantity control device in FIG. 1. FIG. 3 is a side view illustrating a drive unit according to Embodiment 1, in a state where a cover is detached. FIG. 4 is an oblique perspective view illustrating a throttle gear unit. FIG. 5 is an oblique perspective view illustrating a relationship between a throttle gear and a lever, in which only neighboring components of the throttle gear are extracted. FIG. 6 is an explanatory diagram illustrating an example of an angle deviation with respect to a clearance of a fitting portion in the present invention, which is compared with an angle deviation in a conventional art. FIG. 7 is a side view illustrating a connection state of the cover and a throttle body.

In FIG. 1 and FIG. 2, a throttle body 1 composing an intake air passage 13 for an internal combustion engine is formed by, for example, die-casting aluminum. The throttle body 1 includes a throttle valve component 2 for openably and closably supporting a throttle valve 10, and a drive chamber 4 for installing a power transmission mechanism and a motor 3 for driving the throttle valve 10. An open area is formed at a portion of the throttle body 1 (a right end portion in FIG. 1 and FIG. 2), and the open area is covered by a cover 5. The cover 5 is made from, for example, a resin mold, and a rotational angle detector 6 for detecting a rotational angle of the throttle valve 10 is installed in the cover 5. The intake air passage 13 is formed with a circular cross-section shape, and it is extended in a vertical direction to a plane of this paper in FIG. 1 and FIG. 2.

The throttle valve component 2 includes a throttle shaft 7, a first bearing 8 and a second bearing 9, which support both end portions of the throttle shaft 7, the throttle valve 10 having a butterfly shape, which opens or closes the intake air passage 13 in accordance with the rotation of the throttle shaft 7, and a return coil spring 11, provided between a throttle gear 12 and the throttle body 1, which keeps a rotational force in accordance with the rotation of the throttle shaft 7 and returns the throttle shaft 7 to its original state when the rotational force is lost.

The throttle shaft 7 is arranged in such a way that its axial line is orthogonal to the intake air passage 13. The throttle shaft 7 is rotatably supported around the axial line by the first bearing 8 and the second bearing 9. The first bearing 8 is composed of a ball bearing arranged at one end portion (right end portion in FIG. 2) of the throttle shaft 7, and the second bearing 9 is composed of a metal bearing arranged at the other end portion (left end portion in FIG. 2) of the throttle shaft 7.

The throttle valve 10 is composed of a circular plate of which diameter is nearly equal to a diameter of the intake air passage 13, and it is arranged so as to cross the intake air passage 13. The throttle valve 10 is fixed to the throttle shaft 7 by a screw 14 and rotated with the throttle shaft 7. An aperture ratio of the throttle valve 10 is varied in accordance with a rotational position of the throttle valve 10, whereby an intake air quantity of the internal combustion engine is controlled.

The throttle gear 12 provided at one end portion (right end portion in FIG. 2) of the throttle shaft 7 is a resin mold unit having a ring shape, which is provided in such a way that an insert unit 15 connected to the throttle shaft 7 is fitted to the throttle gear 12. The throttle gear 12 is fixed by a nut 16 via the insert unit 15, as illustrated in FIG. 3 and FIG. 4, in such a way that the throttle gear 12 is integrally rotated with the throttle shaft 7. Moreover, a gear tooth portion 17 of the throttle gear 12 is engaged to a motor gear 21 provided at a motor shaft 20 of the drive motor 3, and a driving force of the drive motor 3 is reduced and transmitted to the throttle gear 12.

Moreover, the throttle gear 12 includes a supporting portion 12*a* having a ring shape, by which the insert unit 15 is fitted to the throttle shaft 7, and a fan-shaped portion 12*b* having the gear tooth portion 17. The fan-shaped portion 12*b* is offset in an axial direction of the throttle shaft 7 with respect to the supporting portion 12*a* for the insert unit 15 and the throttle shaft 7. A through-hole 18 is provided at a portion of the fan-shaped portion 12*b*, and a wall portion 19 is formed at one side of the through-hole 18.

The drive motor 3 is fixed to a lower portion of the throttle body 1 in such a way that the motor shaft 20 is parallel with the throttle shaft 7. When the drive motor 3 is driven by an instruction from an external device, it drives the throttle shaft 7 via a power transmission mechanism including the motor gear 21, the throttle gear 12 and the like, and the aperture ratio of the throttle valve 10 is increased by opposing to the return coil spring 11. When a driving force by the drive motor 3 is lost, the throttle valve 10 is returned in a closing direction by the return coil spring 11.

The rotational angle detector 6 integrated with the cover 5 includes a rotor 22 that is rotatably supported in the cover 5, and the rotational angle detector 6 is arranged in such a way that an axis of the rotor 22 is identical to an axis of the throttle shaft 7 when the cover 5 is connected to the throttle body 1. Moreover, a lever 23 is fixed to an end portion of the rotor 22, which is faced to the throttle shaft 7. The lever 23 includes an attaching portion 23*a* that is attached to the rotor 22, an arm portion 23*b* that is extended from the attaching portion 23*a* along the offset direction of the throttle shaft 7, and a protruding portion 23*c* that is formed at a tip of the arm portion 23*b* and more bent in an axial direction of the rotor 22 (refer to FIG. 5).

The protruding portion 23*c* is arranged so as to fit to the wall portion 19 of the throttle gear 12. Moreover, in order to prevent looseness from occurring at a fitting portion of the protruding portion 23*c* and the wall portion 19, a coil spring 26 for pressing the protruding portion 23*c* of the lever toward the wall portion 19 is also provided in the rotational angle detector 6 (refer to FIG. 2).

Moreover, when the cover 5 is connected to the throttle body 1, in order to conform the axis of the throttle shaft 7 to the axis of the rotational angle detector 6 (axis of the rotor), positioning pins 25 are provided at a plurality of positions in the cover 5 (refer to FIG. 7), and the same numbers of halls for inserting the positioning pins 25 are provided at the throttle body 1. Moreover, a motor terminal 27 having a protrusion shape, by which the drive motor 3 is electrically connected, is provided in the cover 5. Moreover, a connector 28 for electrically connecting the drive motor 3 and the rotational angle detector 6 to an external device is provided on the cover 5 (refer to FIG. 1).

Here, a resistance element (not illustrated) is printed on a surface of a board 24 of the rotational angle detector 6, and a constant voltage is usually applied to the resistance element. Meanwhile, a metallic brush (not illustrated) is connected to the rotor 22, and a resistance value of the resistance element, to which electric power is applied by sliding a tip of the brush on the resistance element, is varied by rotating the rotor 22, whereby a variation of the resistance value is outputted as a variation of a rotational angle of the rotor 22.

As described above, in the intake air quantity control device according to Embodiment 1, because the through-hole 18 and the wall portion 19, which are provided at the fan-shaped portion 12*b* of the throttle gear 12, are fitted to the protruding portion 23*c* of the lever 23 in the rotational angle detector 6, space for providing an additional fitting portion is not required, and a length of the intake air quantity control device in an orthogonal direction with respect to the throttle shaft 7 can be decreased. Moreover, because an additional component for forming the fitting portion is not required in the throttle valve component 2, a number of the components can be reduced, and space for installing conventional components can be reduced, whereby a length of the intake air quantity control device in a parallel direction with respect to the throttle shaft 7 can be also decreased.

Moreover, because the protruding portion 23*c* of the lever 23 provided in the rotational angle detector 6 is fitted to the wall portion 19 of the throttle gear 12 at a portion that is significantly separated or far away as much as possible from an axial position of the throttle gear 12, an influence of a clearance, which is exerted on the rotational angle detected by the rotational angle detector 6, can be reduced at a minimum value, when the throttle valve 10 is rotated to detect the rotational angle by the rotational angle detector 6 and a minute clearance is generated at the fitting portion by, for example, a deviation from an axis of the throttle shaft 7 to an axis of the rotor 22 in the rotational angle detector 6.

For example, in FIG. 6, when a fit radius is small, in a case where the throttle shaft 7 is directly fitted into a fitting hole of the rotational angle detector 6, and a fit radius is large, in a case where the throttle shaft 7 is fitted via the lever 23 like in this invention, and if the same amounts of clearances of fitting portions in the both cases are generated (that is: B1=B2), a relationship between an angle deviation A1, in the case where the throttle shaft is directly fitted, and an angle deviation A2, in the case where the throttle shaft is fitted via the lever, is indicated as (A1>A2). Therefore, it is understood that when the fit radius is large, in the case where the lever is fitted, the influence of the clearance, which is exerted on the rotational angle detected by the rotational angle detector 6, is more reduced.

Moreover, because the fitting portion of the throttle gear 12 is formed by the through-hole 18, and the protruding portion 23*c* of the lever 23 provided in the rotational angle detector 6 can be inserted and fitted to the through-hole 18, a sufficient fitting capability is ensured, and a length of the intake air quantity control device in a parallel direction with respect to the throttle shaft 7 can be decreased.

Moreover, because the gear tooth portion 17 of the throttle gear 12 is offset in an axial direction of the throttle shaft 7 (as shown in FIG. 2) with respect to the insert unit 15 fixed to the throttle shaft 7, the rotational angle detector 6 protruded from the cover 5 can be installed in a space around the end portion of the throttle shaft 7, which is formed by offsetting the gear tooth portion 17, and a length of the intake air quantity control device in a parallel direction with respect to the throttle shaft 7 can be decreased.

When the cover 5 is connected to the throttle body 1 at the time of manufacturing the intake air quantity control device, the lever 23 inside the cover 5 must be inserted and fitted to the through-hole 18 of the throttle gear 12 inside the throttle body 1. However, because the wall portion 19 is provided at a lateral side of the through-hole 18 in the throttle gear 12, the lever 23 can be inserted along the wall portion 19, and a connection capability can be substantially improved in comparison with a case where the wall portion 19 is not provided.

Moreover, from a functional viewpoint of the intake air quantity control device, a mechanical totally-closed angle of the rotational angle detector 6 must be smaller than a mechanical totally-closed angle of the throttle valve 10. Moreover, in a recent intake air quantity control device, a fail-safe mechanism is considered, and the throttle valve 10 is slightly opened when electric power is not applied. Therefore, when the cover 5 is connected to the throttle body 1, an angle position of a fitting portion of the throttle gear 12 inside the throttle body 1 is not identical to an angle position of a fitting portion inside the rotational angle detector 6, and the cover 5 must be slightly rotated and connected to the throttle body 1 after the wall portion 19 of the throttle gear 12 is fitted to the protruding portion 23*c* of the lever 23.

At this time, if surrounding protrusions, except for the protruding portion 23*c* of the lever 23, such as the positioning pins 25 and the motor terminal 27, which are protruded from the cover 5, interfere with the throttle body 1, the cover 5 cannot be turned. However, in the intake air quantity control device according to Embodiment 1, because the protruding portion 23*c* of the lever 23 can be formed in such a way that a length of the protruding portion 23*c* is sufficiently longer than lengths of the surrounding protrusions, the cover 5 can be connected to the throttle body 1 without the interference of the surrounding protrusions, and a connection capability can be improved.

Embodiment 2

Figure 8:
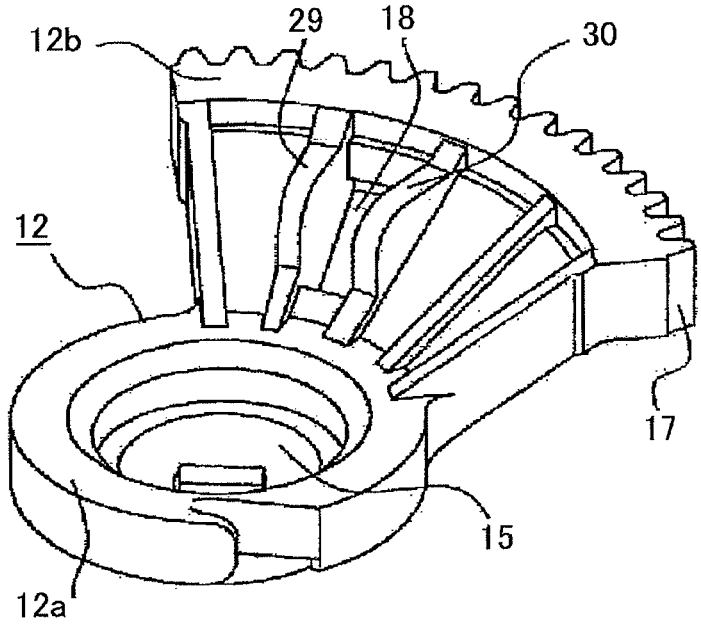
FIG. 8 is an oblique perspective view illustrating a throttle gear unit in an intake air quantity control device for an internal combustion engine according to Embodiment 2 of the present invention.
Figure 9:
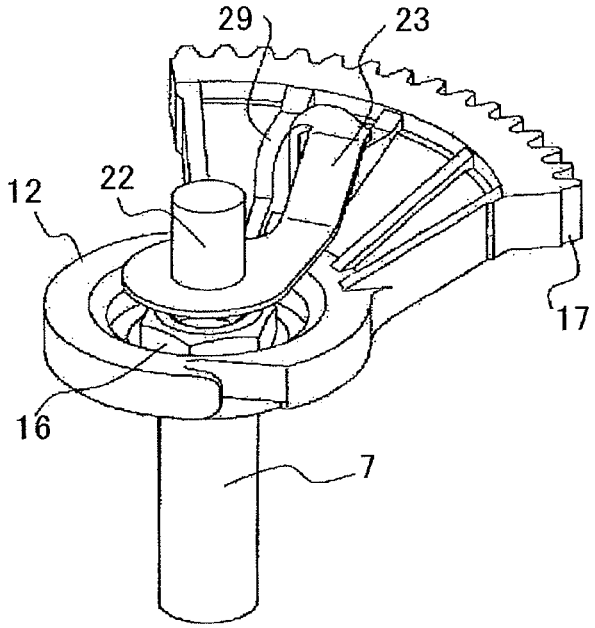
FIG. 9 is an oblique perspective view illustrating a configuration of a fitting portion in a right rotational mode, in which neighboring components of the throttle gear in FIG. 8 are extracted.
Figure 10:
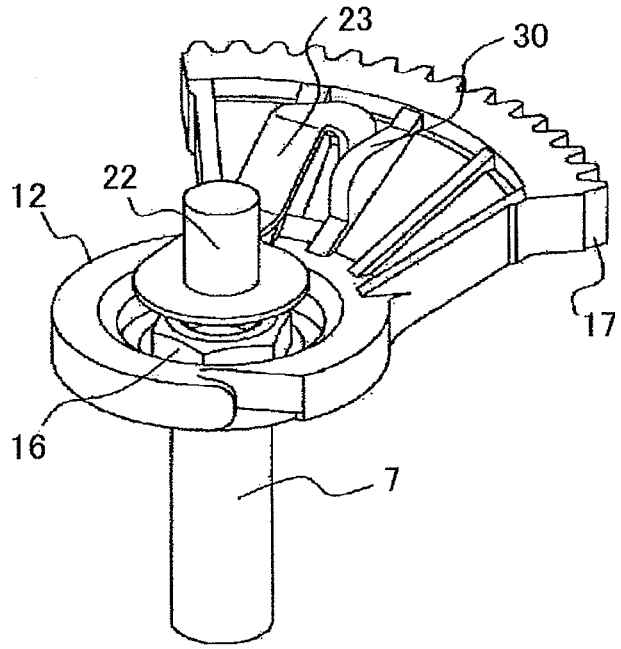
FIG. 10 is an oblique perspective view illustrating a configuration of a fitting portion in a left rotational mode, in which neighboring components of the throttle gear in FIG. 8 are extracted.

FIG. 8 is an oblique perspective view illustrating a throttle gear unit in an intake air quantity control device according to Embodiment 2 of the present invention. FIG. 9 is an oblique perspective view illustrating a configuration of a fitting portion in a right rotational mode, in which only neighboring components of the throttle gear are extracted. FIG. 10 is an oblique perspective view illustrating a configuration of a fitting portion in a left rotational mode, in which only neighboring components of the throttle gear are extracted.

In FIG. 8, although one through-hole 18 is provided in a throttle gear 12 in a similar way to Embodiment 1, a first wall portion 29 and a second wall portion 30 are provided at both sides of the through-hole 18.

In this case, regarding rotational directions of a throttle valve 10 in the intake air quantity control device, there are two rotational directions—a right rotational direction and a left rotational direction—in accordance with a mounting attitude or the like in a car. Therefore, in a right rotational mode and a left rotational mode, pressing directions by a coil spring in a rotational angle detector 6 are different at a fitting portion, so that the throttle gear 12 including a fitting portion corresponding to the right rotational mode and the left rotational mode must be prepared.

In the intake air quantity control device according to Embodiment 2 of the present invention, the first wall portion 29 and the second wall portion 30 are formed along both sides of the through-hole 18 in the throttle gear 12, and both wall portions can be used as fitting portions, so that one kind of throttle gear 12 can be ready for the intake air quantity control device even if a rotational direction is changed, and commonality of the components can be achieved.

Embodiment 3

Figure 11:
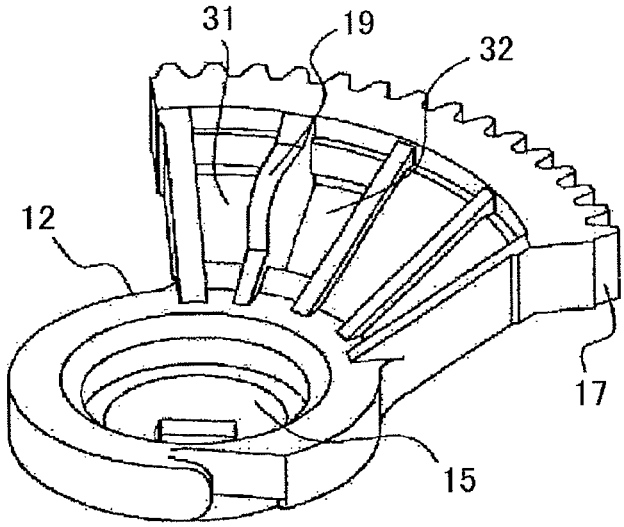
FIG. 11 is an oblique perspective view illustrating a throttle gear unit in an intake air quantity control device for an internal combustion engine according to Embodiment 3 of the present invention.
Figure 12:
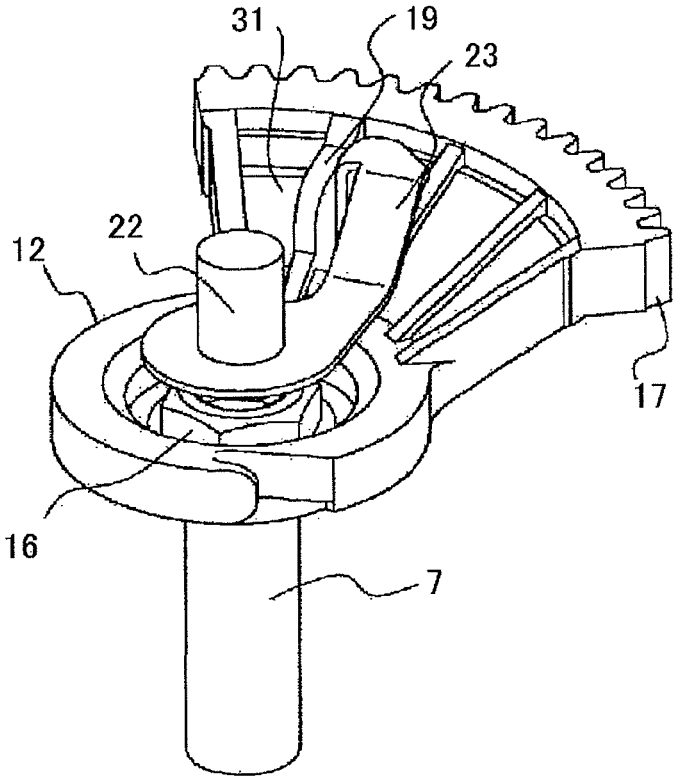
FIG. 12 is an oblique perspective view illustrating a configuration of a fitting portion in a right rotational mode, in which neighboring components of the throttle gear in FIG. 11 are extracted.
Figure 13:
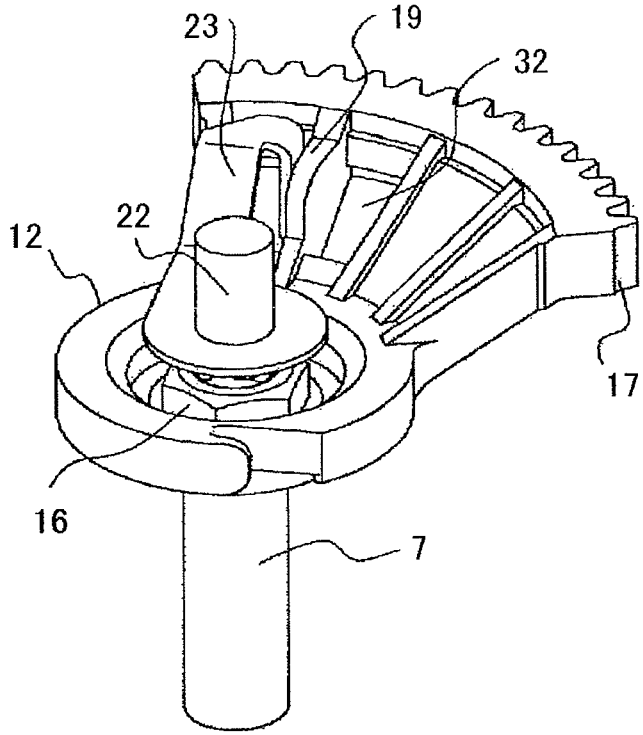
FIG. 13 is an oblique perspective view illustrating a configuration of a fitting portion in a left rotational mode, in which neighboring components of the throttle gear in FIG. 11 are extracted.

FIG. 11 is an oblique perspective view illustrating a throttle gear unit in an intake air quantity control device according to Embodiment 3 of the present invention. FIG. 12 is an oblique perspective view illustrating a configuration of a fitting portion in a right rotational mode, in which only neighboring components of the throttle gear are extracted. FIG. 13 is an oblique perspective view illustrating a configuration of a fitting portion in a left rotational mode, in which only neighboring components of the throttle gear are extracted.

In FIG. 11, although one wall portion 19 is provided in a throttle gear 12 in a similar way to Embodiment 1, a first through-hole 31 and a second through-hole 32 are provided at both sides of the wall portion 19.

In the intake air quantity control device according to Embodiment 3 of the present invention, the first through-hole 31 and the second through-hole 32 are formed along both sides of the wall portion 19 in the throttle gear 12, and both sides of the wall portion 19 can be used as fitting portions, so that one kind of throttle gear 12 can be ready for the intake air quantity control device even if a rotational direction is changed, and commonality of the components can be achieved.

Embodiment 4

Figure 14:
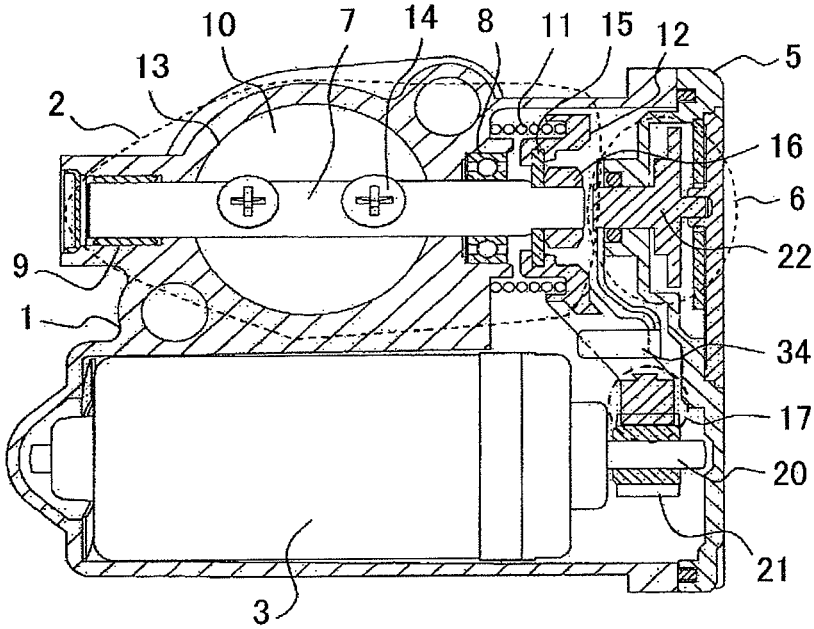
FIG. 14 is a front cross-sectional view illustrating an intake air quantity control device for an internal combustion engine according to Embodiment 4 of the present invention.
Figure 15:
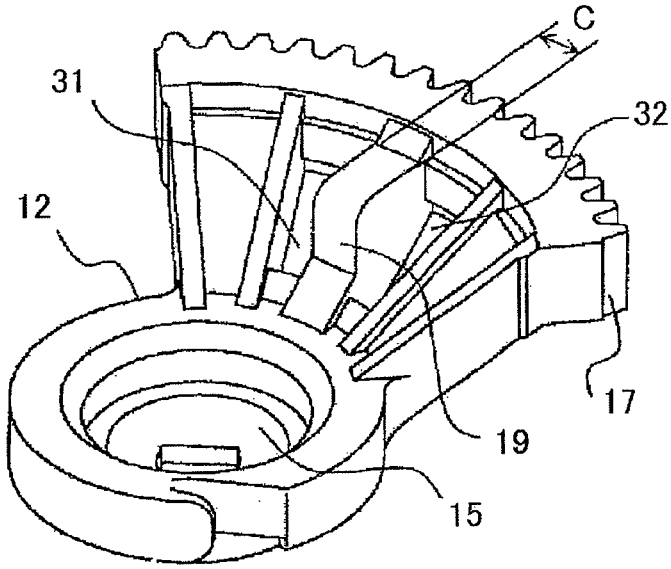
FIG. 15 is an oblique perspective view illustrating a throttle gear unit in FIG. 14.
Figure 16:
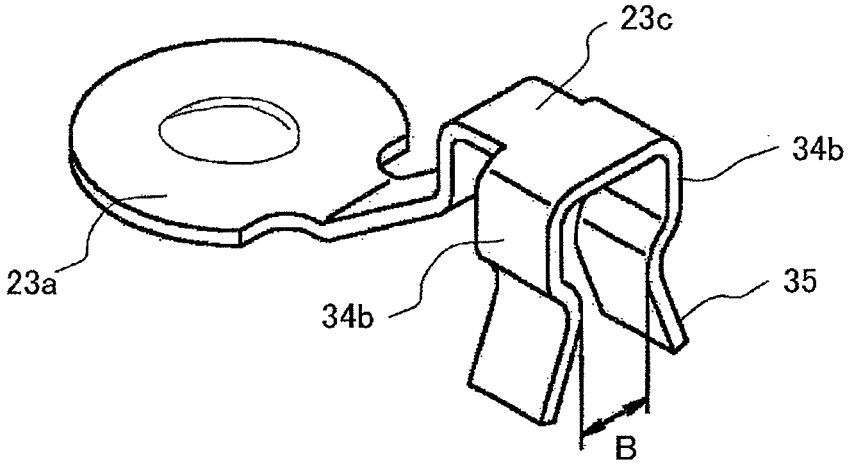
FIG. 16 is an oblique perspective view illustrating a lever unit in FIG. 14.
Figure 17:
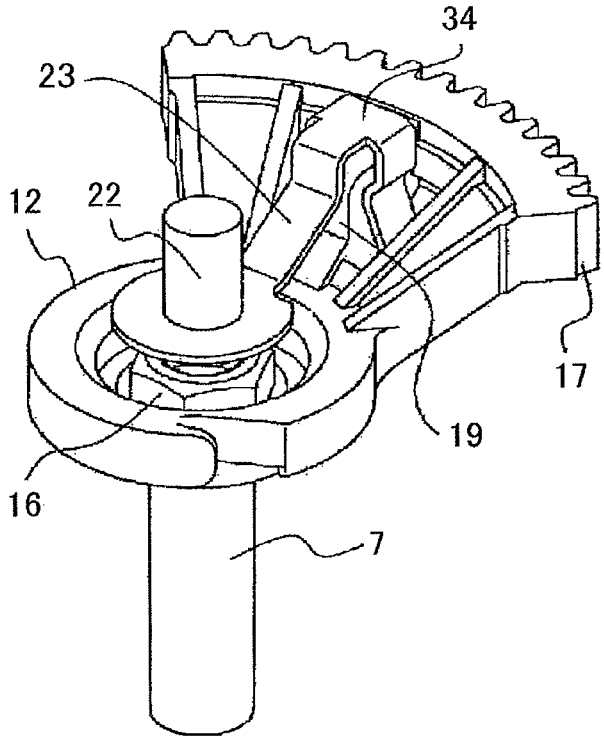
FIG. 17 is an oblique perspective view illustrating a configuration of a fitting portion, in which neighboring components of the throttle gear in FIG. 14 are extracted.

FIG. 14 is a front cross-sectional view illustrating an intake air quantity control device according to Embodiment 4 of the present invention. FIG. 15 is an oblique perspective view illustrating a throttle gear unit. FIG. 16 is an oblique perspective view illustrating a lever unit. FIG. 17 is an oblique perspective view illustrating a configuration of a fitting portion, in which only the throttle gear and the lever are extracted.

A pair of clamping portions 34*a* and 34*b* having a concave shape with a constant width "B" are provided at a protruding portion 23*c* formed at a tip of a lever 23 that is attached to a rotor 22 of a rotational angle detector 6, and tips of the pair of clamping portions 34*a* and 34*b* include tapered portions 35 of which tips are widened with a trapezoidal shape. Moreover, a wall portion 19 with a constant width "C" is provided in a throttle gear 12, and a first through-hole 31 and a second through-hole 32 are formed along both sides of the wall portion 19, whereby the lever 23 is fitted in such a way that the wall portion 19 of the throttle gear 12 is clamped by the clamping portions 34*a* and 34*b* having a concave shape, which are formed at a tip of the lever 23. Moreover, it is defined that the constant width B of the clamping portions 34*a* and 34*b* having a concave shape, which are formed at the tip of the lever 23, is narrower than the constant width C of the wall portion 19 in the throttle gear 12, and sizes of the width B and the width C are defined in such a way that the wall portion 19 is slightly pressed by the clamping portions 34*a* and 34*b* in a fitting state.

In the intake air quantity control device according to Embodiment 4 of the present invention, the wall portion 19 of the throttle gear 12 is slightly pressed and clamped by the clamping portions 34*a* and 34*b* having a concave shape, which are formed at the tip of the lever 23, so that looseness does not occur at the fitting portion, and it is not required that the protruding portion 23*c* is pressed toward one side of the wall portion 19 by the coil spring 26 in the rotational angle detector 6 as described in Embodiment 1 through Embodiment 3. Therefore, the coil spring 26 in the rotational angle detector 6 is not necessary, and a number of the components can be reduced, and the throttle gear 12 can be ready for the throttle valve 10 in a right rotational mode as well as in a left rotational mode, so that commonality of the components can be achieved.

What is claimed is:

1. An intake air quantity control device for an internal combustion engine, comprising:

a throttle body that comprises a throttle valve component for openably/closably supporting a throttle valve by a throttle shaft, and a drive chamber for installing a motor for driving the throttle valve, and a fan-shaped throttle gear fixed to one end portion of the throttle shaft and having a fitting portion at a portion of the throttle gear, wherein an open area formed at a portion of the throttle body is encapsulated by a cover including a rotational angle detector;

wherein said rotational angle detector including:

a rotor that is rotatably supported and arranged in the cover in such a way that an axis of the rotor is identical to an axis of the throttle gear; and a lever that is provided at a portion of the rotor, which is faced to the throttle shaft, and engaged to the fitting portion of the throttle gear at a portion of the lever.

2. An intake air quantity control device for an internal combustion engine as recited in claim 1, wherein the throttle gear includes:

a ring-shaped supporting portion for fitting an insert unit fixed to the throttle shaft; and a fan-shaped portion at which a gear tooth portion is offset in an axial direction of the throttle shaft with respect to the supporting portion for the insert unit and the throttle shaft, and the rotational angle detector protruded from the cover is installed in a space formed by offsetting the gear tooth portion.

3. An intake air quantity control device for an internal combustion engine as recited in claim 2, wherein the lever includes:

an attaching portion by which the lever is attached to a rotor;

an arm portion that is extended from the attaching portion along the offset direction of the throttle gear; and a protruding portion that is bent in an axial direction of the rotor at a tip of the arm portion and extended into the fitting portion of the throttle gear.

4. An intake air quantity control device as recited in claim 1, wherein the protruding portion of the lever is pressed toward the fitting portion of the throttle gear by a spring force of a coil spring installed in the rotational angle detector, and the fitting portion of the throttle gear is formed by a wall portion or a through-hole, which are provided at a portion of the fan-shaped portion, or formed by both the means.

5. An intake air quantity control device as recited in claim 4, wherein the fitting portion of the throttle gear is formed at a portion that is separated from an axial position of the throttle gear and located at a position where a radius is large.

6. An intake air quantity control device as recited in claim 4, wherein a plurality of wall portions which are faced to one through-hole are provided in the throttle gear.

7. An intake air quantity control device as recited in claim 4, wherein a plurality of through-holes which are faced to one wall portion are provided in the throttle gear.

8. An intake air quantity control device as recited in claim 1, wherein a pair of clamping portions having a concave shape are provided at a protruding portion of the lever, and a wall portion having a constant width and a plurality of through-holes are provided in the throttle gear so as to clamp the wall portion, and the wall portion of the throttle gear is clamped by the pair of clamping portions having a concave shape of the lever.

9. An intake air quantity control device as recited in claim 5, wherein the pair of the clamping portions having a concave shape include tapered portions of which tips are widened with a trapezoidal shape, and a distance between the pair of the clamping portions having a concave shape is narrower than a width of the wall portion of the throttle gear.

* * * * *